US010254704B1

(12) United States Patent
Mizoguchi et al.

(10) Patent No.: US 10,254,704 B1
(45) Date of Patent: Apr. 9, 2019

(54) CHARGING DEVICE, UNIT FOR IMAGE-FORMING APPARATUS, PROCESS CARTRIDGE, AND IMAGE-FORMING APPARATUS

(71) Applicant: FUJI XEROX CO.,LTD., Tokyo (JP)

(72) Inventors: Satoshi Mizoguchi, Kanagawa (JP); Fuyuki Kano, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/943,729

(22) Filed: Apr. 3, 2018

(30) Foreign Application Priority Data

Sep. 27, 2017 (JP) ..... 2017-185984

(51) Int. Cl.
*G03G 15/02* (2006.01)
*G03G 21/00* (2006.01)

(52) U.S. Cl.
CPC ..... *G03G 21/0058* (2013.01); *G03G 15/0258* (2013.01); *G03G 2221/0005* (2013.01); *G03G 2221/1618* (2013.01); *G03G 2221/183* (2013.01)

(58) Field of Classification Search
CPC ..... G03G 21/0058; G03G 21/0258; G03G 15/0216; G03G 15/0258; B41F 35/006; B41P 2235/22
See application file for complete search history.

(56) References Cited

U.S. PATENT DOCUMENTS 4,673,284 A * 6/1987 Matsumoto ..... G03G 21/0035 15/1.51
4,870,465 A * 9/1989 Lindblad ..... G03G 21/0005 399/347
5,128,725 A * 7/1992 Frankel ..... G03G 21/0035 15/256.5
5,216,467 A * 6/1993 Esser ..... G03G 15/0898 15/159.1
6,061,867 A * 5/2000 Schorpp ..... B41F 35/02 15/230.12
2005/0063728 A1* 3/2005 Harada ..... G03G 15/0225 399/100
2011/0170898 A1* 7/2011 Yamaura ..... G03G 15/0225 399/100
2013/0149001 A1* 6/2013 Miyake ..... G03G 15/0225 399/100

FOREIGN PATENT DOCUMENTS

JP 2013152492 5/2013

* cited by examiner

*Primary Examiner* — Walter L Lindsay, Jr.
*Assistant Examiner* — Arlene Heredia
(74) *Attorney, Agent, or Firm* — JCIPRNET

(57) ABSTRACT

A charging device includes a charging member that charges a member to be charged and a cleaning member that is disposed in contact with a surface of the charging member and that cleans the surface of the charging member. The cleaning member includes a core and two foamed elastic layers disposed adjacent to each other in an axial direction around an outer peripheral surface of the core from one end to another end of the core in a substantially double-helical pattern. The two foamed elastic layers are a first foamed elastic layer having an average skeleton size D1 smaller than an average spacing Sm between irregularities in the surface of the charging member and a second foamed elastic layer having an average skeleton size D2 larger than or equal to the average spacing Sm between the irregularities in the surface of the charging member.

14 Claims, 9 Drawing Sheets

CHARGING DEVICE, UNIT FOR IMAGE-FORMING APPARATUS, PROCESS CARTRIDGE, AND IMAGE-FORMING APPARATUS

CROSS-REFERENCE TO RELATED APPLICATIONS

This application is based on and claims priority under 35 USC 119 from Japanese Patent Application No. 2017-185984 filed Sep. 27, 2017.

BACKGROUND

(i) Technical Field

The present invention relates to charging devices, units for image-forming apparatuses, process cartridges, and image-forming apparatuses.

(ii) Related Art

In electrophotographic image formation, an image is formed by charging and exposing a photoreceptor surface to form an electrostatic latent image, developing the electrostatic latent image with charged toner to form a toner image, and transferring and fixing the toner image to a recording medium such as paper. Image-forming apparatuses for performing such image formation are equipped with members that perform various processes such as charging, exposure, and transfer and cleaning members that clean the surfaces of these members.

SUMMARY

According to an aspect of the invention, there is provided a charging device including a charging member that charges a member to be charged and a cleaning member that is disposed in contact with a surface of the charging member and that cleans the surface of the charging member. The cleaning member includes a core and two foamed elastic layers disposed adjacent to each other in an axial direction around an outer peripheral surface of the core from one end to another end of the core in a substantially double-helical pattern. The two foamed elastic layers are a first foamed elastic layer having an average skeleton size D1 smaller than an average spacing Sm between irregularities in the surface of the charging member and a second foamed elastic layer having an average skeleton size D2 larger than or equal to the average spacing Sm between the irregularities in the surface of the charging member.

BRIEF DESCRIPTION OF THE DRAWINGS

Exemplary embodiments of the present invention will be described in detail based on the following figures, wherein.

DETAILED DESCRIPTION

Figure 1:
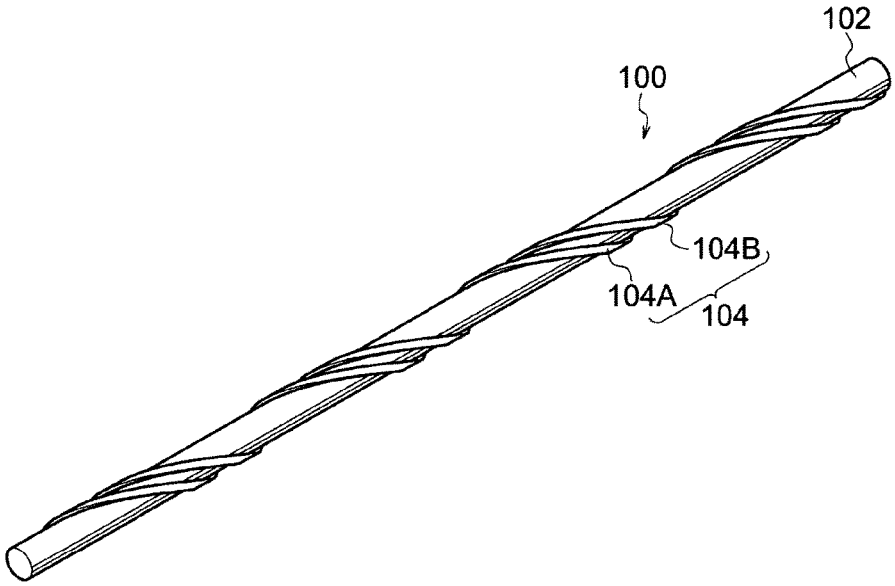
FIG. 1 is a schematic perspective view showing an example cleaning member.

An exemplary embodiment serving as an example of the present invention will hereinafter be described. It should be noted that members that function and operate in the same manner are indicated by the same reference numerals throughout the drawings and that a description thereof may be omitted.

The various elements in the drawings are not necessarily drawn to scale; rather, they are presented merely to clearly illustrate the principles of the disclosure and may be exaggerated.

As used herein, "electrophotographic photoreceptor" is also simply referred to as "photoreceptor".

Charging Device

A charging device according to this exemplary embodiment includes a charging member that charges a member to be charged and a cleaning member that is disposed in contact with a surface of the charging member and that cleans the surface of the charging member. The cleaning member includes a core and two foamed elastic layers disposed adjacent to each other in an axial direction around an outer peripheral surface of the core from one end to another end of the core in a double-helical pattern or in a substantially double-helical pattern. The two foamed elastic layers are a first foamed elastic layer having an average skeleton size D1 smaller than an average spacing Sm between irregularities in the surface of the charging member and a second foamed elastic layer having an average skeleton size D2 larger than or equal to the average spacing Sm between the irregularities in the surface of the charging member.

The cleaning member of the charging device according to this exemplary embodiment will first be described with reference to the drawings.

Cleaning Member

Figure 2:
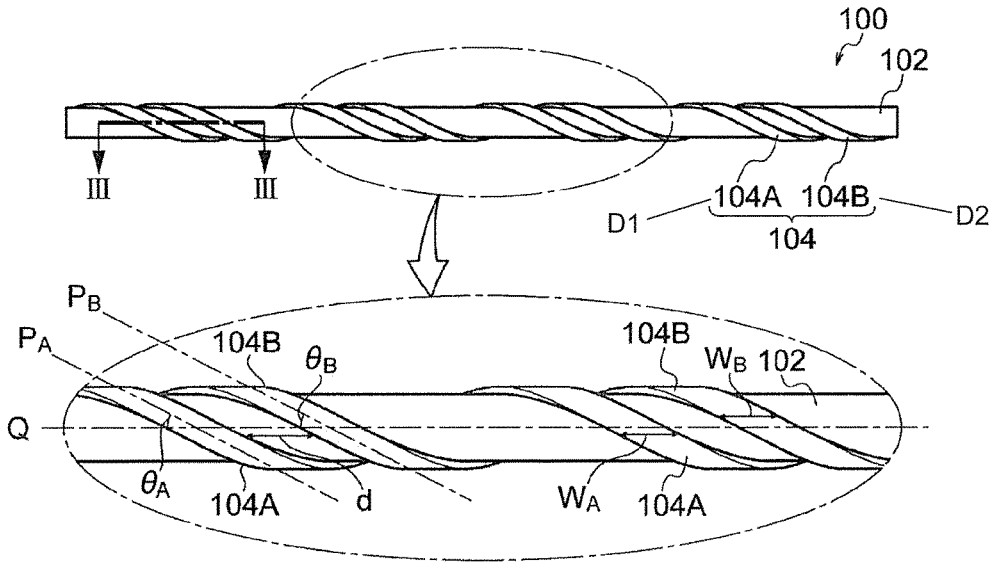
FIG. 2 is a schematic plan view showing the example cleaning member.
Figure 3:
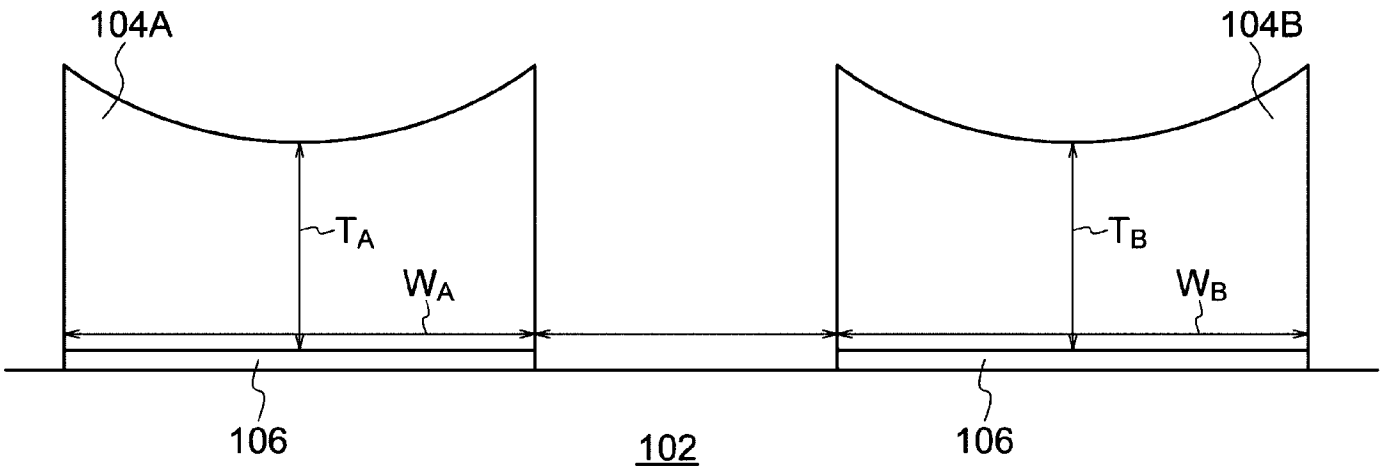
FIG. 3 is an enlarged sectional view showing two foamed elastic layers of the example cleaning member.

FIG. 1 is a schematic perspective view showing an example cleaning member. FIG. 2 is a schematic plan view showing the example cleaning member. FIG. 3 is an enlarged sectional view showing two foamed elastic layers of the example cleaning member. FIG. 3 is a sectional view taken along line III-III in FIG. 2, i.e., a partial enlarged view of a cross-section of the cleaning member taken in the axial direction of the core.

Foamed elastic layers 104A and 104B are also collectively referred to as "foamed elastic layer 104".

As shown in FIGS. 1 and 2, a cleaning member 100 is a roller-shaped member including a core 102 and two foamed elastic layers 104 disposed in a double-helical pattern or in a substantially double-helical pattern.

As shown in FIGS. 1 and 2, the two foamed elastic layers 104 are wound adjacent to each other in the axial direction around the outer peripheral surface of the core 102 from one end to the other end of the core 102 in a double-helical pattern or in a substantially double-helical pattern. Specifically, the two foamed elastic layers 104 are formed by winding two strip-shaped foamed elastic members with the same period at a distance from each other around the outer peripheral surface of the core 102 using the core 102 as a helix axis such that the foamed elastic members are disposed in a double-helical pattern or in a substantially double-helical pattern.

The two foamed elastic layers 104 are a first foamed elastic layer 104A having an average skeleton size D1 smaller than the average spacing Sm between irregularities in the surface of the charging member and a second foamed elastic layer 104B having an average skeleton size D2 larger than or equal to the average spacing Sm between the irregularities in the surface of the charging member.

That is, the average spacing Sm (μm) between the irregularities in the surface of the charging member, the average skeleton size D1 (μm) of the first foamed elastic layer 104A, and the average skeleton size D2 (μm) of the second foamed elastic layer 104B satisfy the following relationship:

Average skeleton size D1 (μm)<average spacing Sm (μm) between irregularities≤average skeleton size D2 (μm)

"First foamed elastic layer 104A" is hereinafter also simply referred to as "foamed elastic layer 104A", whereas "second foamed elastic layer 104B" is hereinafter also simply referred to as "foamed elastic layer 104B".

Conventionally, a cleaning member including one or more foamed elastic layers disposed around an outer peripheral surface of a core in a helical pattern is disposed in contact with a charging member whose surface is movable (e.g., driven to rotate) to clean the surface of the charging member.

Cleaning with such a cleaning member is performed by wiping the surface of the charging member and scraping off any foreign matter with the foamed elastic layers of the cleaning member.

Charging members, on the other hand, have small irregularities formed in the surface thereof for reasons such as improving the charging performance on the member to be charged, inhibiting the phenomenon in which foreign matter is pressed and spread into a thin film and adheres to the surface (i.e., filming), and reducing the load during sliding over a photoreceptor and thereby improving the wear resistance of the charging member and the photoreceptor against each other. If such a surface of a charging member is cleaned with a cleaning member as described above, foreign matter may remain in depressions in the surface, and some of the scraped-off foreign matter may remain on the surface of the charging member. Thus, foreign matter is gradually deposited over irregularities in the surface of the charging member. An increased amount of foreign matter deposited and in-plane variation in the presence of foreign matter due to local deposition of foreign matter on areas such as projections may vary the charging characteristics.

That is, to inhibit variation in the charging performance of the charging member, sufficient cleaning performance is needed to minimize an increase in the amount of foreign matter deposited on the surface of the charging member and to reduce the likelihood of in-plane variation in the presence of foreign matter.

The cleaning member according to this exemplary embodiment includes the two foamed elastic layers 104 disposed around the outer peripheral surface of the core 102 in a double-helical pattern or in a substantially double-helical pattern. The two foamed elastic layers 104 are the first foamed elastic layer 104A, which has an average skeleton size D1 smaller than the average spacing Sm between the irregularities in the surface of the charging member, and the second foamed elastic layer 104B, which has an average skeleton size D2 larger than or equal to the average spacing Sm between the irregularities in the surface of the charging member.

The first foamed elastic layer 104A, which has an average skeleton size D1 smaller than the average spacing Sm between the irregularities in the surface of the charging member, will easily enter the irregularities in the surface of the charging member because of its small skeleton size and will also contribute to scraping off of any foreign matter from the surface of the charging member (particularly from depressions) because of its flexibility derived from the skeleton size.

In addition, the second foamed elastic layer 104B, which has an average skeleton size D2 larger than or equal to the average spacing Sm between the irregularities in the surface of the charging member, will function to level, in a plane, any foreign matter remaining on the surface of the charging member and any foreign matter scraped off by the first foamed elastic layer 104A but remaining on the surface because of its rigidity derived from the large skeleton size.

Furthermore, since the first foamed elastic layer 104A and the second foamed elastic layer 104B are disposed in a double-helical pattern or in a substantially double-helical pattern, the first foamed elastic layer 104A and the second foamed elastic layer 104B alternately and continuously scrape off and level any foreign matter.

Thus, with the charging device according to this exemplary embodiment, an increase in the amount of foreign matter deposited on the surface of the charging member and in-plane variation in the presence of foreign matter may be inhibited, thus improving the maintenance of cleaning performance over an extended period of time.

Here, the average spacing Sm between the irregularities in the surface of the charging member, the average skeleton size D1 of the first foamed elastic layer 104A, and the average skeleton size D2 of the second foamed elastic layer 104B will be described.

The average spacing Sm between the irregularities in the surface of the charging member is a measure of the surface roughness of the charging member in accordance with JIS B 0601-1994.

Here, the average spacing Sm between the irregularities in this exemplary embodiment is determined by sampling a standard length from a roughness curve in the direction of the mean line, calculating the sum of lengths of the mean line corresponding to one peak and its neighboring valley within the sampled segment, and expressing the arithmetic mean spacing between the numerous irregularities in micrometers (μm).

The average spacing Sm between the irregularities in the surface of the charging member is measured with a contact surface profilometer (SURFCOM 570A, manufactured by Tokyo Seimitsu Co., Ltd.) in an environment at 23° C. and 55% RH. The measurement distance is 2.5 mm. A diamond-tipped stylus (5 μm in radius, 90° cone) is used. The average of three measurements taken at different sites is used as the average spacing Sm between the irregularities in the surface of the charging member.

In this exemplary embodiment, it is preferred that the average spacing Sm between the irregularities in the surface of the charging member be from 50 μm to 300 μm or from about 50 μm to about 300 μm, more preferably from 70 μm to 250 μm or from about 70 μm to about 250 μm, for reasons such as improving the charging performance on the member to be charged and inhibiting the phenomenon in which foreign matter is pressed and spread into a thin film and adheres to the surface (i.e., filming).

The average skeleton size D1 of the first foamed elastic layer 104A and the average skeleton size D2 of the second foamed elastic layer 104B refer to the minimum distance between adjacent foam cells, i.e., the average minimum thickness of cell walls defining foam cells.

The method for measuring the average skeleton sizes D1 and D2 will hereinafter be described.

The regions near the surfaces of the foamed elastic layers 104A and 104B disposed around the outer peripheral surface of the core 102 are first observed from the side thereof under a VHX-900 microscope (manufactured by Keyence Corporation) at 100× magnification.

Foam cells present in a region extending 2 mm from the surface are identified. The minimum distances between adjacent foam cells (the minimum thicknesses of cell walls defining adjacent foam cells) at ten points are measured, and the average thereof is calculated.

In this exemplary embodiment, it is preferred that the average skeleton size D1 of the foamed elastic layer 104A be from 0.3 times to 0.8 times or from about 0.3 times to about 0.8 times, more preferably from 0.5 times to 0.7 times or from about 0.5 times to about 0.7 times, the average spacing Sm between the irregularities in the surface of the charging member in order to facilitate scraping off of any foreign matter from the surface of the charging member (particularly from depressions).

To ensure sufficient rigidity to scrape off any foreign matter from the surface of the charging member, the average skeleton size D1 may be 0.3 times or more the average spacing Sm between the irregularities in the surface of the charging member. For the same reason, the average skeleton size D1 may be 30 μm or more.

In this exemplary embodiment, it is preferred that the average skeleton size D2 of the foamed elastic layer 104B be from 1.2 times to 3.2 times or from about 1.2 times to about 3.2 times, more preferably from 1.5 times to 2.5 times or from about 1.5 times to about 2.5 times, even more preferably from 1.5 times to 2.0 times or from about 1.5 times to about 2.0 times, the average spacing Sm between the irregularities in the surface of the charging member in order to facilitate leveling of any foreign matter remaining of the surface of the charging member.

To ensure sufficient conformity to the surface profile of the charging member, the average skeleton size D2 may be 3.2 times or less the average spacing Sm between the irregularities in the surface of the charging member. For the same reason, the average skeleton size D2 may be 600 μm or less.

The individual components of the cleaning member will hereinafter be described.

The core 102 will be described first.

Examples of materials that may be used for the core 102 include metals, alloys, and resins.

Examples of metals and alloys include metals such as iron (e.g., free-cutting steel), copper, brass, aluminum, and nickel and alloys such as stainless steel.

Examples of resins include polyacetal resins; polycarbonate resins; acrylonitrile-butadiene-styrene copolymers; polypropylene resins; polyester resins; polyolefin resins; polyphenylene ether resins; polyphenylene sulfide resins; polysulfone resins; polyethersulfone resins; polyarylene resins; polyetherimide resins; polyvinyl acetal resins; polyketone resins; polyetherketone resins; polyetheretherketone resins; polyarylketone resins; polyether nitrile resins; liquid crystal resins; polybenzimidazole resins; polyparabanic acid resins; vinyl polymers and copolymers obtained by polymerization or copolymerization of one or more vinyl monomers selected from the group consisting of aromatic alkenyl compounds, methacrylates, acrylates, and vinyl cyanide compounds; diene-aromatic alkenyl compound copolymers; vinyl cyanide-diene-aromatic alkenyl compound copolymers; aromatic alkenyl compound-diene-vinyl cyanide-N-phenylmaleimide copolymers; vinyl cyanide-(ethylene-diene-propylene (EPDM))-aromatic alkenyl compound copolymers; polyolefin resins; vinyl chloride resins; and chlorinated vinyl chloride resins. One of these resins may be used alone, or two or more of these resins may be used in combination.

The material and the method of surface treatment, for example, may be selected as needed. In particular, if the core 102 is formed of a metal, the core 102 may be subjected to plating treatment. If the core 102 is formed of a nonconductive material such as a resin, the core 102 may be treated to be conductive by common treatment such as plating treatment or may be used without such treatment.

The foamed elastic layers 104 will be described next.

The foamed elastic layers 104 are formed of a bubble-containing material (i.e., a foam) that returns to its original shape when deformed by the application of an external force of 100 Pa.

Examples of materials that may be used for the foamed elastic layers 104 include foamable resins such as polyurethane, polyethylene, polyamide, melamine, and polypropylene; and rubber materials such as silicone rubber, fluorocarbon rubber, urethane rubber, ethylene-propylene-diene rubber (EPDM), acrylonitrile-butadiene rubber (NBR), chloroprene rubber (CR), chlorinated polyisoprene, isoprene, styrene-butadiene rubber, hydrogenated polybutadiene, and butyl rubber. One or a mixture of two or more of these materials may be used.

The same material or different materials may be used for the foamed elastic layer 104A and the foamed elastic layer 104B.

Additives may also be added to these materials, including auxiliary blowing agents, foam stabilizers, catalysts, curing agents, plasticizers, and vulcanization accelerators.

In particular, the foamed elastic layers 104 may be formed of a foamed polyurethane, which is resistant to tension, in order to prevent scratches on the surface of the charging member due to rubbing and to prevent tear and damage over an extended period of time.

Examples of foamed polyurethanes include reaction products of polyols (e.g., polyester polyols, polyether polyols, and acrylic polyols) with isocyanates (e.g., 2,4-tolylene diisocyanate, 2,6-tolylene diisocyanate, 4,4-diphenylmethane diisocyanate, tolidine diisocyanate, and 1,6-hexamethylene diisocyanate) and those further reacted with chain extenders (e.g., 1,4-butanediol and trimethylolpropane).

Polyurethanes are typically foamed with blowing agents such as water and azo compounds (e.g., azodicarbonamide and azobisisobutyronitrile).

Additives may also be added to foamed polyurethanes, including auxiliary blowing agents, foam stabilizers, and catalysts.

Among these foamed polyurethanes, ether-based foamed polyurethanes are preferred since ester-based foamed polyurethanes tend to deteriorate with heat and moisture. Silicone oil foam stabilizers are typically used for ether-based polyurethanes. Such silicone oil, however, may migrate to the charging member during storage (particularly during storage at high temperature and high humidity), thus causing image defects. Accordingly, stabilizers other than silicone oils may be used to inhibit the migration of the foam stabilizer to the charging member and thereby inhibit image defects due to the migration of the foam stabilizer.

Here, specific examples of foam stabilizers other than silicone oils include Si-free organic surfactants (e.g., anionic surfactants such as dodecylbenzenesulfonates and sodium lauryl sulfate). Methods of manufacture without silicone foam stabilizers are also applicable.

It is determined whether or not foamed polyurethanes contain foam stabilizers other than silicone oils based on whether or not their component analysis indicates the presence of "Si".

The average skeleton size D1 of the foamed elastic layer 104A and the average skeleton size D2 of the foamed elastic layer 104B may be controlled by adjusting the pressure applied in the direction perpendicular to the foaming direction during foaming when foamed elastic members, described later, are fabricated. As the pressure becomes higher, the resulting foamed elastic members tend to have smaller skeleton sizes.

Commercially available foamed elastic layers having the target average skeleton size may also be used.

The helix widths $W_A$ and $W_B$, the helix angles $\theta_A$ and $\theta_B$, the separation distance d, and the thicknesses $T_A$ and $T_B$ of the foamed elastic layers 104A and 104B will be described next.

As shown in FIG. 2, the helix widths $W_A$ and $W_B$ refer to the lengths of the foamed elastic layers 104A and 104B in the axial direction Q of the core 102 as the foamed elastic layers 104A and 104B are wound in a helical pattern.

As shown in FIG. 2, the helix angles $\theta_A$ and $\theta_B$ refer to the angle (acute angle) at which the axial direction Q of the core 102 and the longitudinal direction $P_A$ (helix direction) of the foamed elastic layer 104A cross each other and the angle (acute angle) at which the axial direction Q of the core 102 and the longitudinal direction $P_B$ (helix direction) of the foamed elastic layer 104B cross each other as the foamed elastic layers 104A and 104B are wound in a helical pattern.

As shown in FIG. 2, the separation distance d refers to the shorter one of the distances between the adjacent foamed elastic layers 104 and 104B in the axial direction Q of the core 102 as the foamed elastic layers 104A and 104B are wound in a helical pattern.

As shown in FIG. 3, the thicknesses $T_A$ and $T_B$ refer to the thickness in the center of the foamed elastic layer 104A in the width direction and the thickness in the center of the foamed elastic layer 104B in the width direction as the foamed elastic layers 104A and 104B are wound in a helical pattern.

The helix width $W_A$ of the foamed elastic layer 104A and the helix width $W_B$ of the foamed elastic layer 104B may be appropriately set depending on factors such as the ease of achieving the respective functions of the foamed elastic layers 104A and 104B, the function required depending on the surface profile of the charging member, the peel resistance of the foamed elastic layers 104A and 104B, and the ease of manufacture.

Specifically, it is preferred that the helix widths $W_A$ and $W_B$ be each 3 mm or more, more preferably 4 mm or more, even more preferably 5 mm or more, in order to easily achieve the respective functions of the foamed elastic layers 104A and 104B. The helix widths $W_A$ and $W_B$ correspond to the widths of the foamed elastic layers 104A and 104B.

It is also preferred that the upper limits of the helix widths $W_A$ and $W_B$ be each 10 mm or less, more preferably 7 mm or less, depending on the helix angles θ, described later, in order to easily achieve the respective functions of the foamed elastic layers 104A and 104B.

The helix widths $W_A$ and $W_B$ may be the same or different. The foamed elastic layers 104A and 104B are wound in a double-helical pattern or in a substantially double-helical pattern at the helix angles $\theta_A$ and $\theta_B$, respectively, with respect to the axial direction of the core 102. To form a double helix, it is preferred that the difference between the helix angles $\theta_A$ and $\theta_B$ be 5° or less, more preferably 3° or less.

The helix angles $\theta_A$ and $\theta_B$ may be appropriately set depending on factors such as the ease of achieving the respective functions of the foamed elastic layers 104A and 104B, the function required depending on the surface profile of the charging member, and the peel resistance of the foamed elastic layers 104A and 104B.

Specifically, the helix angles $\theta_A$ and $\theta_B$ are each preferably from 2° to 75°, more preferably from 4° to 75°, even more preferably from 8° to 45°.

As shown in FIGS. 2 and 3, the separation distance d between the foamed elastic layer 104A and the foamed elastic layer 104B may be appropriately set depending on factors such as the ease of achieving the respective functions of the foamed elastic layers 104A and 104B and the ease of fabrication.

Specifically, the separation distance d between the foamed elastic layer 104A and the foamed elastic layer 104B is preferably 10 mm or less, more preferably from 0 mm to 5 mm.

Figure 4:
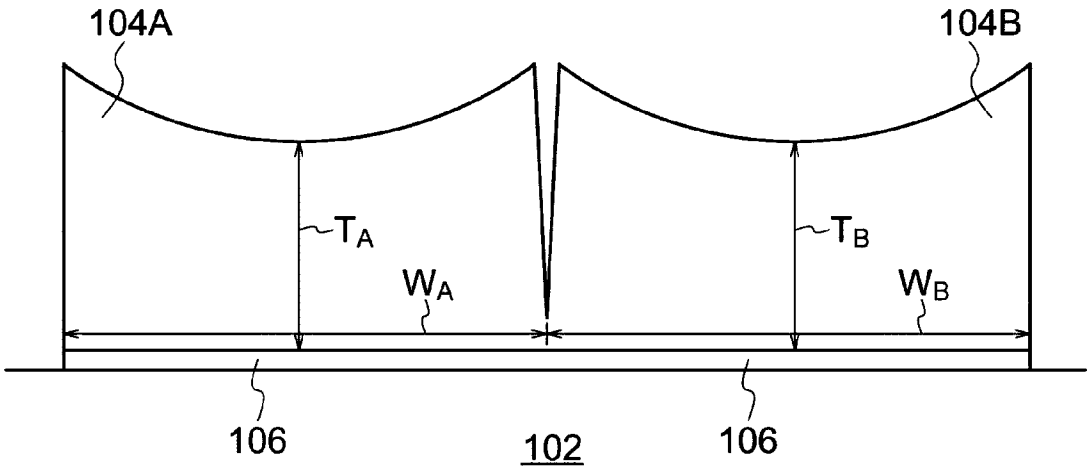
FIG. 4 is an enlarged sectional view showing two foamed elastic layers of another example cleaning member.

That is, as shown in FIG. 4, the separation distance d between the foamed elastic layer 104A and the foamed elastic layer 104B may be zero.

As shown in FIG. 3, the thicknesses $T_A$ and $T_B$ (the thicknesses in the center in the width direction) of the foamed elastic layers 104A and 104B may be appropriately set depending on factors such as the ease of achieving the respective functions of the foamed elastic layers 104A and 104B.

Specifically, the thicknesses $T_A$ and $T_B$ are each preferably from 1.0 mm to 4.0 mm, more preferably from 1.5 mm to 3.0 mm, even more preferably from 1.7 mm to 2.5 mm.

The thicknesses $T_A$ and $T_B$ may be the same or different. If the thicknesses $T_A$ and $T_B$ are different, the difference in thickness may be set depending on the significance of the respective functions of the foamed elastic layers 104A and 104B. Preferably, one thickness $T_A$ or $T_B$ is from more than 1 time to 1.2 times or from more than about 1 time to about 1.2 times the other thickness $T_B$ or $T_A$.

The thicknesses $T_A$ and $T_B$ of the foamed elastic layers 104A and 104B are measured by the following method.

Specifically, the profile of a foamed elastic layer (the thickness of the foamed elastic layer) is measured with a laser instrument (manufactured by Mitutoyo Corporation, Laser Scan Micrometer, model: LSM6200) by scanning the foamed elastic layer in the longitudinal direction (axial direction) of the cleaning member at a traverse speed of 1 mm/s, with the peripheral direction of the cleaning member being fixed. The position in the peripheral direction is then shifted, and a measurement is made in the same manner (at three positions at intervals of 120° in the peripheral direction). Based on this profile, the thickness in the center in the width direction of the foamed elastic layer is calculated.

It is preferred that the number of turns of the foamed elastic layers 104A and 104B be each 1 or more, more preferably 1.3 or more, even more preferably 2 or more, in order to reduce the likelihood of poor rotation as the cleaning member 100 rotates together with the charging member and to easily achieve the respective functions of the foamed elastic layers 104A and 104B.

If the cleaning member 100 rotates together with the charging member, there is no particular upper limit to the number of turns of the foamed elastic layers 104A and 104B around the core 102 since the number of turns depends on the length of the core to be cleaned.

If the cleaning member 100 is provided with its own rotating mechanism independent of the charging member, rather than rotating together with the charging member, there is no particular limit to the number of turns of the foamed elastic layers 104A and 104B around the core 102.

In some cases, the cleaning member 100 has regions that need not exhibit the cleaning performance on the charging member near the ends in the axial direction. In such cases, the foamed elastic layers 104 need not be present in those regions near the ends of the cleaning member 100.

Adhesive layers 106 will be described next.

As shown in FIG. 3, the foamed elastic layers 104 described above are bonded to the core 102 with the adhesive layers 106 therebetween.

The adhesive layers 106 may be any layer capable of bonding the core 102 and the foamed elastic layers 104 together. For example, the adhesive layers 106 may be formed of a double-sided tape or another adhesive.

As shown in FIG. 4, the foamed elastic layer 104A and the foamed elastic layer 104B may be disposed around the core 102 at a separation distance d of zero, i.e., with one edge of the foamed elastic layer 104A being in contact with one edge of the foamed elastic layer 104B.

In the case of the form mentioned above, as shown in FIG. 4, different adhesive layers 106 may be provided for the foamed elastic layers 104A and 104B, or a single adhesive layer 106 may be provided to simultaneously bond the foamed elastic layers 104A and 104B.

A method for manufacturing the cleaning member 100 will be described next.

Figure 5A:
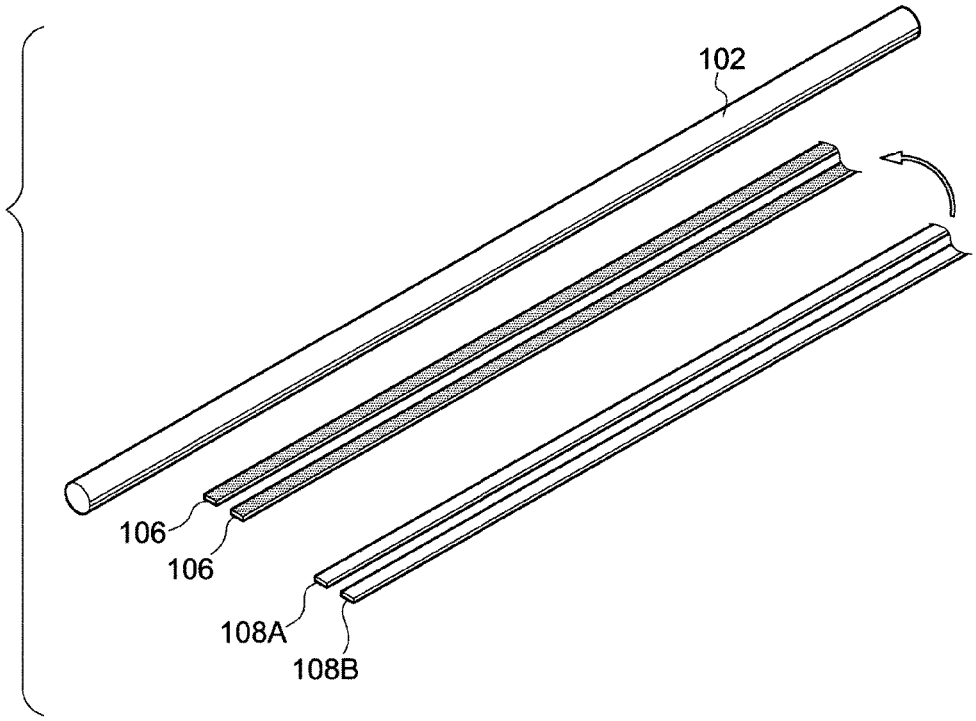
FIG. 5A is a process view showing an example method for manufacturing a cleaning member.
Figure 5B:
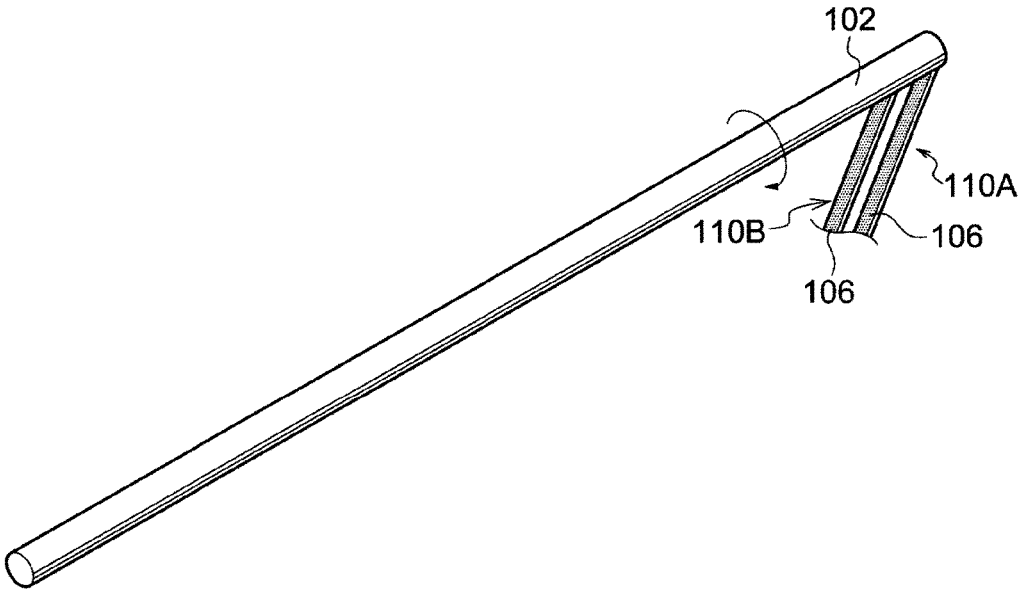
FIG. 5B is a process view showing the example method for manufacturing a cleaning member.
Figure 5C:
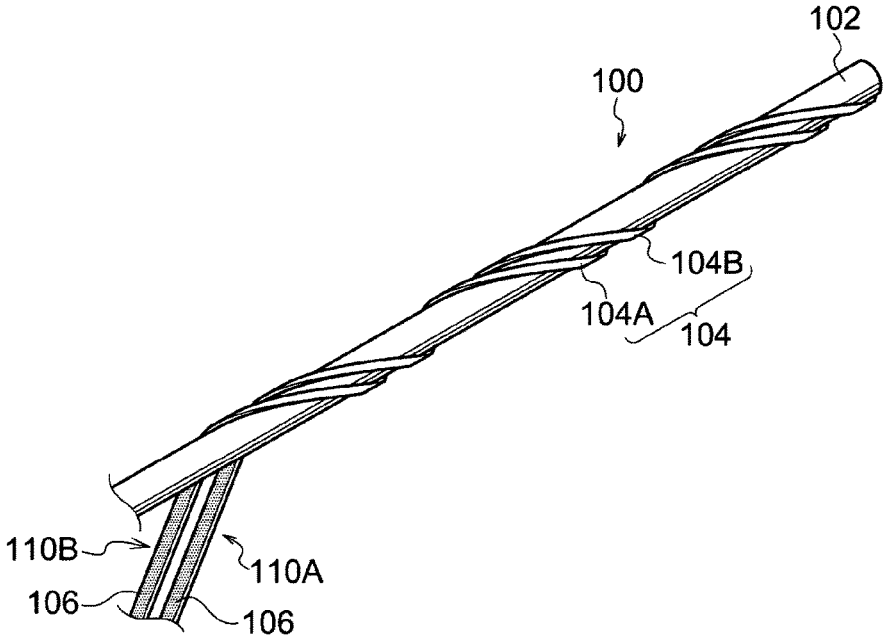
FIG. 5C is a process view showing the example method for manufacturing a cleaning member.

FIGS. 5A to 5C are process views showing an example method for manufacturing the cleaning member 100.

As shown in FIG. 5A, to obtain the foamed elastic layers 104A and 104B, sheet-shaped foamed elastic members (e.g., foamed polyurethane sheets) subjected to slicing to the target thickness are first provided. These sheet-shaped foamed elastic members are cut to obtain strip-shaped foamed elastic members 108A and 108B having the target width and length.

Double-sided tapes (hereinafter also referred to as "double-sided tapes 106") having adhesive surfaces of the same size as the strip-shaped foamed elastic members 108A and 108B are also provided.

The strip-shaped foamed elastic members 108A and 108B are bonded on one side to the double-sided tapes, serving as the adhesive layers 106, to obtain strips 110A and 110B (strip-shaped elastic members with the double-sided tapes 106) having the target width and length.

The core 102 is also provided.

As shown in FIG. 5B, the strips 110A and 110B are then placed such that the sides with the double-sided tapes 106 face upward. In this state, one end of the release paper is stripped from each double-sided tape 106, and one end of the core 102 is placed at the end of each double-sided tape 106 from which the release paper has been stripped.

As shown in FIG. 5C, the release paper is then stripped from each double-sided tape 106 while the core 102 is rotated at the target speed to wind the strips 110A and 110B around the outer peripheral surface of the core 102 in a double-helical pattern or in a substantially double-helical pattern to obtain the cleaning member 100 including the foamed elastic layers 104A and 104B disposed around the outer peripheral surface of the core 102 in a double-helical pattern or in a substantially double-helical pattern.

Although the method illustrated in FIGS. 5A to 5C involves simultaneously winding the strips 110A and 110B around the core 102, the method for manufacturing the cleaning member 100 is not limited thereto.

It is also possible to wind the strip 110A and then wind the strip 104B around the core 102 or to wind the strips 110A and 110B in the reverse order.

Here, when the strips 110A and 110B, serving as the foamed elastic layers 104A and 104B, are wound around the core 102, the strips 110A and 110B may be positioned relative to the core 102 such that the longitudinal direction of the strips 110A and 110B makes the target angle (helix angle) with the axial direction of the core 102.

The core 102 may have an outer diameter of, for example, from 2 mm to 12 mm.

If a tension is applied when the strips 110A and 110B are wound around the core 102, the tension may be high enough to leave no gap between the core 102 and the double-sided tapes 106 of the strips 110A and 110B.

Specifically, for example, the tension may be high enough to cause an elongation of from 0% to 5% of the original length of the strips 110A and 110B.

The strips 110A and 110B tend to elongate as the strips 110A and 110B are wound around the core 102. This elongation differs in the thickness direction of the strips 110A and 110B, with the outermost portion tending to elongate more. Accordingly, the elongation of the outermost portion after the winding of the strips 110A and 110B around the core 102 may be about 5% of the original length of the outermost portion of the strips 110A and 110B. An excessive elongation may result in a decreased elastic force of the foamed elastic layers 104A and 104B.

This elongation is controlled by the radius of curvature of the strips 110A and 110B wound around the core 102 and the thickness of the strips 110A and 110B. The radius of curvature of the strips 110A and 110B wound around the core 102 is controlled by the outer diameter of the core 102 and the winding angle of the strips 110A and 110B (helix angle θ).

For example, the radius of curvature of the strips 110A and 110B wound around the core 102 may range from ((outer diameter of core/2)+1 mm) to ((outer diameter of core/2)+15 mm), desirably from ((outer diameter of core/2)+1.5 mm) to ((outer diameter of core/2)+5.0 mm).

The end portions of the strips 110A and 110B in the longitudinal direction may be subjected to compression treatment in the thickness direction of the strips 110A and 110B. This compression treatment may inhibit peeling of the strips 110A and 110B after bonding to the core 102.

Specifically, for example, the end portions of the strips 110A and 110B in the longitudinal direction before bonding to the core 102 may be subjected to compression treatment (thermal compression treatment) in which heat and pressure are applied so that the percentage of compression in the thickness direction of the strips 110A and 110B (thickness after compression/thickness before compression×100) is from 10% to 70%. By this compression treatment, the end portions of the strips 110A and 110B in the longitudinal direction are plastically deformed into a flat shape.

The cleaning member of the charging device according to this exemplary embodiment, as described above, is not limited to a configuration including only two foamed elastic layers (foamed elastic layer 104A and foamed elastic layer 104B) as described above, but may include another elastic layer that does not interfere with the advantages of this exemplary embodiment.

That is, the cleaning member of the charging device according to this exemplary embodiment may include, in addition to the first foamed elastic layer 104A having the average skeleton size D1 and the second foamed elastic layer 104B having the average skeleton size D2, another elastic layer disposed around the outer peripheral surface of the core in a multiple-helical pattern.

The other elastic layer may be a known elastic layer of a cleaning member and may be either a foamed elastic layer or an unfoamed elastic layer. Two or more other elastic layers may be provided.

Charging Member

The charging member whose surface is to be cleaned with the cleaning member described above (i.e., the charging member of the charging device according to this exemplary embodiment) will be described next.

The charging member includes, for example, a core and an elastic layer.

The elastic layer may be a single layer or a stack of multiple layers. The elastic layer may be surface-treated or may have a surface layer containing a polymeric material on the outer peripheral surface of the elastic layer.

The core may be formed of a material such as free-cutting steel or stainless steel and may be subjected to surface plating treatment. If the core is formed of a nonconductive material, the core may be treated to be conductive by treatment such as plating treatment.

The elastic layer is a conductive elastic layer.

The conductive elastic layer contains an elastic material such as rubber and a conductor such as carbon black or an ionic conductor. For example, the conductor is mixed and dispersed in the elastic material. The elastic layer may further contain other materials such as softeners, plasticizers, curing agents, vulcanizing agents, vulcanization accelerators, age resistors, lubricants, and fillers (e.g., silica and calcium carbonate). The conductive elastic layer is formed by coating the outer peripheral surface of a conductive core with a mixture of the above materials. The elastic material may be a foam. In this case, the conductive elastic layer is a conductive foamed elastic layer.

Examples of elastic materials that may be used to form the conductive elastic layer include silicone rubber, ethylene-propylene rubber, epichlorohydrin rubber, epichlorohydrin-ethylene oxide copolymer rubber, epichlorohydrin-ethylene oxide-allyl glycidyl ether copolymer rubber, acrylonitrile-butadiene copolymer rubber, and mixtures thereof. A single elastic material may be used alone, or two or more elastic materials may be used in combination.

Examples of conductors include electronic conductors and ionic conductors. Examples of electronic conductors include powders such as carbon blacks such as Ketjen black and acetylene black; pyrolytic carbon and graphite; conductive metals and alloys such as aluminum, copper, nickel, and stainless steel; conductive metal oxides such as tin oxide, indium oxide, titanium oxide, tin oxide-antimony oxide solid solutions, and tin oxide-indium oxide solid solutions; and insulating materials surface-treated to be conductive. Examples of ionic conductors include perchlorates and chlorates of oniums such as tetraethylammonium and lauryltrimethylammonium; and perchlorates and chlorates of alkali metals and alkaline earth metals such as lithium and magnesium.

A single conductor may be used alone, or two or more conductors may be used in combination. In the case of an electronic conductor, the amount of conductor added may be, but not limited to, from 1 part by weight to 60 parts by weight per 100 parts by weight of the elastic material. In the case of an ionic conductor, the amount of conductor added may be, but not limited to, from 0.1 parts by weight to 5.0 parts by weight per 100 parts by weight of the elastic material.

The charging member may have a surface layer containing a polymeric material on the surface thereof.

Examples of polymeric materials that may be present in the surface layer include polyvinylidene fluoride, tetrafluoroethylene copolymers, polyesters, polyimides, and nylon copolymers. Nylon copolymers are copolymers containing polymerized units of one or more of nylon 610, nylon 11, and nylon 12 and may contain other polymerized units such as those of nylon 6 and nylon 66. The total content of nylon 610, nylon 11, and nylon 12 in nylon copolymers may be 10% by weight or more.

It is desirable that these polymeric materials have a number average molecular weight of from 1,000 to 100,000, more desirably from 10,000 to 50,000. One of these polymeric materials may be used alone, or two or more of these polymeric materials may be used in combination. The polymeric material present in the surface layer may be a fluorinated or silicone-based resin.

A conductive material may be incorporated into the surface layer to adjust the resistance value thereof. The conductive material may be a powder having a particle size of 3 μm or less. Examples of conductive materials intended to adjust the resistance value include carbon black, conductive metal oxide particles, and ionic conductors. A single conductive material may be used alone, or two or more conductive materials may be used in combination.

Specific examples of carbon black include "SPECIAL BLACK 350", "SPECIAL BLACK 100", "SPECIAL BLACK 250", "SPECIAL BLACK 5", "SPECIAL BLACK 4", "SPECIAL BLACK 4A", "SPECIAL BLACK 550", "SPECIAL BLACK 6", "COLOR BLACK FW200", "COLOR BLACK FW2", and "COLOR BLACK FW2V" manufactured by Orion Engineered Carbons; and "MONARCH 1000", "MONARCH 1300", "MONARCH 1400", "MOGUL-L", and "REGAL 400R" manufactured by Cabot Corporation. Carbon black may have a pH of 4.0 or less.

Examples of conductive metal oxide particles include particles of conductors containing electrons as charge carriers, such as tin oxide, antimony-doped tin oxide, zinc oxide, anatase-type titanium oxide, and indium tin oxide (ITO).

The surface layer may contain insulating particles such as alumina and silica.

Depending on the particle size, the content, and the dispersion state of the specific particles present in the surface layer, irregularities are formed in the surface of the charging member, and the average spacing Sm between the irregularities in the surface of the charging member is adjusted to the range mentioned above.

The charging member may have an outer diameter of from 8 mm to 16 mm.

The charging member may have a microhardness of from 45° to 60°.

Although a charging device according to this exemplary embodiment has been described above, a cleaning member forming such a charging device may also be a member that cleans a member to be cleaned other than charging members.

In this case, the two foamed elastic layers of the cleaning member are a first foamed elastic layer having an average skeleton size D1 smaller than an average spacing Sm between irregularities in the surface of the member to be cleaned and a second foamed elastic layer having an average skeleton size D2 larger than or equal to the average spacing Sm between the irregularities in the surface of the member to be cleaned.

Examples of members to be cleaned other than charging members include transfer members, sheet transport belts, second transfer members (e.g., second transfer rollers) for intermediate transfer systems, and intermediate transfer members (e.g., intermediate transfer belts) for intermediate transfer systems.

Such a member to be cleaned and a cleaning member disposed in contact therewith may be combined into a unit for an image-forming apparatus. A process cartridge attachable to and detachable from an image-forming apparatus may include the unit for an image-forming apparatus.

Image-Forming Apparatus and Other Equipment

An image-forming apparatus and other equipment according to this exemplary embodiment will hereinafter be described with reference to the drawings.

Figure 6:
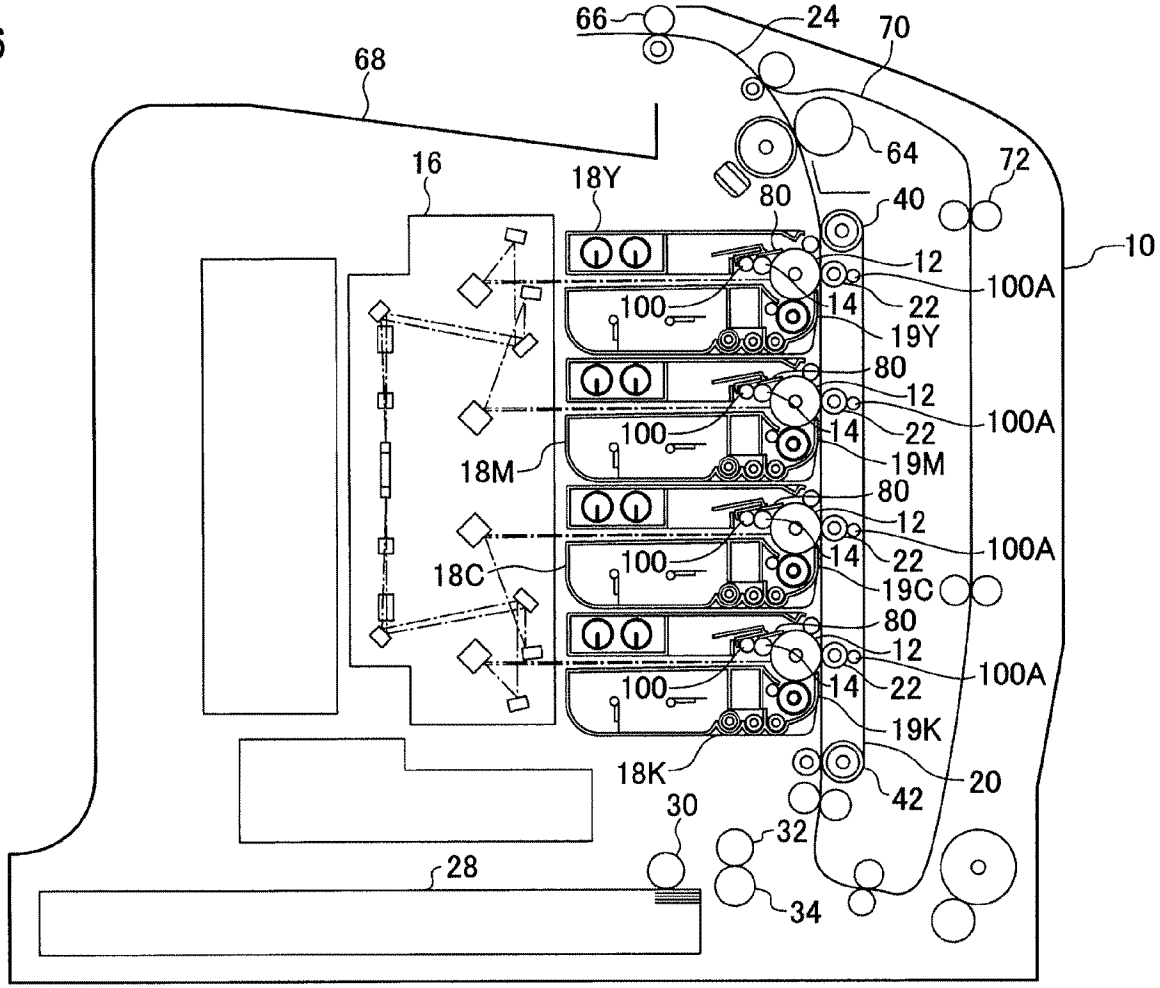
FIG. 6 is a schematic configuration view showing an example image-forming apparatus according to this exemplary embodiment.
Figure 7:
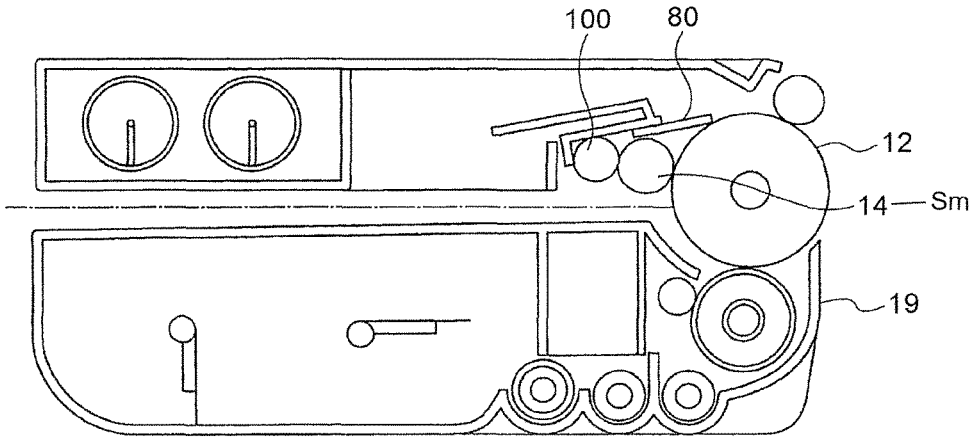
FIG. 7 is a schematic configuration view showing an example process cartridge according to this exemplary embodiment.
Figure 8:
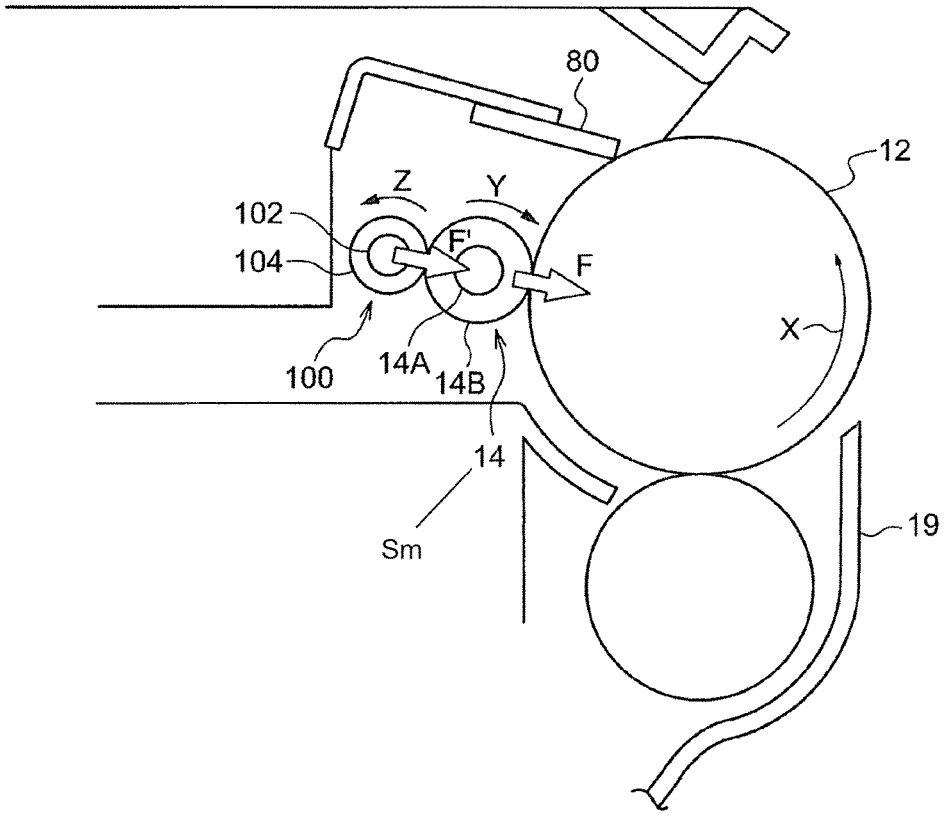
FIG. 8 is a schematic configuration view showing an enlarged view of a charging device and its surrounding area in FIGS. 6 and 7.

FIG. 6 is a schematic configuration view showing an example image-forming apparatus according to this exemplary embodiment. FIG. 7 is a schematic configuration view showing an example process cartridge according to this exemplary embodiment. FIG. 8 is a schematic configuration view showing an enlarged view of a charging device and its surrounding area in FIGS. 6 and 7.

An image-forming apparatus 10 shown in FIG. 6 is a tandem, direct-transfer color image-forming apparatus. The image-forming apparatus 10 has yellow (Y), magenta (M), cyan (C), and black (K) process cartridges 18Y, 18M, 18C, and 18K disposed therein. The process cartridges 18Y, 18M, 18C, and 18K are attachable to and detachable from the image-forming apparatus 10. For example, as shown in FIGS. 7 and 8, the process cartridges 18Y, 18M, 18C, and 18K each include a photoreceptor 12, a charging member 14, and a developing device 19.

The photoreceptor 12 is, for example, a conductive cylinder (e.g., 25 mm in diameter) having its surface covered with a photosensitive layer formed of a material such as an organic photoconductive material. The photoreceptor 12 is driven to rotate by a motor (not shown) at a speed of, for example, 150 mm/sec.

The surface of the photoreceptor 12 is charged by the charging member 14, which is disposed on the surface of the photoreceptor 12. After being charged, the photoreceptor 12 is exposed to a laser beam emitted from an exposure device 16 on the downstream side in the rotational direction of the photoreceptor 12 to form an electrostatic latent image corresponding to image information.

The electrostatic latent image formed on the photoreceptor 12 is developed into a toner image by the developing device 19. To form a color image, the surface of the photoreceptor 12 for each color is subjected to charging, exposure, and developing processes to form a toner image corresponding to each color on the surface of the photoreceptor 12 for that color.

The toner images formed on the photoreceptors 12 are transferred to a recording sheet 24 transported by a sheet transport belt 20 at the positions where the photoreceptors 12 and transfer members 22 are in contact with the sheet transport belt 20 therebetween. The sheet transport belt 20 is tensioned and supported on the inner peripheral surface thereof by support rollers 40 and 42 and transports the recording sheet 24. The recording sheet 24 is picked up from a sheet storage container 28 by a pickup roller 30 and is transported to the sheet transport belt 20 by transport rollers 32 and 34.

The toner images of the individual colors are transferred to the recording sheet 24 in the order in which the four process cartridges are arranged, i.e., black (K), cyan (C), magenta (M), and yellow (Y).

The recording sheet 24 having the toner images transferred thereto is transported to a fixing device 64. The fixing device 64 fixes the toner images to the recording sheet 24 by heating and pressing. For simplex printing, the recording sheet 24 having the toner images fixed thereto is then output to an output section 68 disposed in the top portion of the image-forming apparatus 10 by an output roller 66. For duplex printing, the recording sheet 24 having the toner images fixed to the first side (front side) thereof is transported to a sheet transport path 70 for duplex printing by the reverse rotation of the output roller 66. The recording sheet 24 is then transported again to the sheet transport belt 20 in an inverted position by transport rollers 72 disposed on the sheet transport path 70. Toner images are transferred from the photoreceptors 12 to the second side (back side) of the recording sheet 24. The recording sheet 24 having the toner images transferred to the second side (back side) thereof is then transported to the fixing device 64. The fixing device 64 fixes the toner images to the recording sheet 24. The recording sheet 24 having the toner images fixed to both sides thereof is then output to the output section 68 by the output roller 66.

After the transfer of the toner images is completed, any deposits such as residual toner and paper dust are removed from the surfaces of the photoreceptors 12 by cleaning blades 80 disposed downstream of the positions where transfer occurs in the rotational direction for every rotation of the photoreceptors 12 to prepare for the next image-forming process.

Each transfer member 22 is, for example, a roller including a conductive elastic layer disposed on the outer peripheral surface of a conductive core. The conductive core is rotatably supported inside the image-forming apparatus 10. A cleaning member 100A for the transfer member 22 is disposed in contact with the transfer member 22 on the side of the transfer member 22 facing away from the photoreceptor 12. That is, the transfer member 22 and the cleaning member 100A form a transfer device (unit) (see FIG. 6). As the cleaning member 100A, for example, the cleaning member (the cleaning member of the charging device according to this exemplary embodiment) 100 shown in FIG. 1 may be used. The cleaning member 100A may be, for example, any of a member that is disposed in constant contact with the transfer member 22 and that rotates together with the transfer member 22, a member that comes into contact with the transfer member 22 only during cleaning and that rotates together with the transfer member 22, and a member that comes into contact with the transfer member 22 only during cleaning and that is separately driven to rotate.

Each charging member 14 is, for example, as shown in FIG. 8, a roller including a foamed elastic layer 14B disposed on the outer peripheral surface of a conductive core 14A. The conductive core 14A is rotatably supported inside the developing device 19. The cleaning member (the cleaning member of the charging device according to this exemplary embodiment) 100, described above, for the charging member 14 is disposed in contact with the charging member 14 on the side of the charging member 14 facing away from the photoreceptor 12. That is, the charging member 14 and the cleaning member 100 form a charging device (unit)

according to this exemplary embodiment (see FIGS. 7 and 8). The cleaning member 100 may be, for example, any of a member that is disposed in constant contact with the charging member 14 and that rotates together with the charging member 14, a member that comes into contact with the charging member 14 only during cleaning and that rotates together with the charging member 14, and a member that comes into contact with the charging member 14 only during cleaning and that is separately driven to rotate.

The charging member 14 is, for example, as shown in FIG. 8, pressed against the photoreceptor 12 as a load F is applied to both ends of the conductive core 14A. Accordingly, the foamed elastic layer 14B is elastically deformed to form a nip along the outer peripheral surface of the photoreceptor 12.

On the other hand, the cleaning member 100 is, for example, as shown in FIG. 8, pressed against the charging member 14 as a load F' is applied to both ends of the core 102. Accordingly, the foamed elastic layer 104 is elastically deformed to form a nip along the outer peripheral surface of the charging member 14.

In the example configuration shown in FIG. 8, the photoreceptor 12 is driven to rotate by a motor (not shown) in the direction indicated by arrow X. As the photoreceptor 12 rotates, the charging member 14 rotates together with the photoreceptor 12 in the direction indicated by arrow Y. As the charging member 14 rotates, the cleaning member 100 rotates together with the charging member 14 in the direction indicated by arrow Z.

Although an example image-forming apparatus and an example process cartridge according to this exemplary embodiment have been described above with reference to FIGS. 6 to 8, this exemplary embodiment is not limited thereto.

The image-forming apparatus according to this exemplary embodiment is not limited to the tandem, direct-transfer system shown in FIG. 6; rather, known image-forming apparatuses such as intermediate transfer systems are applicable. In addition, the devices and members disposed in the image-forming apparatus according to this exemplary embodiment may each be directly disposed without being combined into cartridges.

Instead of the charging device according to this exemplary embodiment, the image-forming apparatus and the process cartridge according to this exemplary embodiment may include the unit, described above, for an image-forming apparatus according to this exemplary embodiment.

The process cartridge including the charging device according to this exemplary embodiment (the process cartridge according to this exemplary embodiment) may be a process cartridge including a charging device (a unit including a charging member and a cleaning member) and at least one other device selected from a photoreceptor, an exposure device, a developing device, and a transfer device.

EXAMPLES

Exemplary embodiments of the invention will hereinafter be described in detail with reference to the following examples, although these examples should not be construed as limiting the exemplary embodiments of the invention in any way.

Fabrication of Foamed Elastic Member 1

A melamine foam sheet (BASOTECT Type G) manufactured by Inoac Corporation is used to obtain Sheet-Shaped Foamed Elastic Member 1 having a thickness of 2.4 mm.

Fabrication of Foamed Elastic Member 2

A foamed urethane sheet (EP-70) manufactured by Inoac Corporation is used to obtain Sheet-Shaped Foamed Elastic Member 2 having a thickness of 2.4 mm.

Fabrication of Foamed Elastic Member 3

A foamed urethane sheet (ER-1) manufactured by Inoac Corporation is used to obtain Sheet-Shaped Foamed Elastic Member 3 having a thickness of 2.4 mm.

Fabrication of Foamed Elastic Member 4

A foamed urethane sheet (MF-40) manufactured by Inoac Corporation is used to obtain Sheet-Shaped Foamed Elastic Member 4 having a thickness of 2.4 mm.

Fabrication of Foamed Elastic Member 5

A foamed urethane sheet (MF-30) manufactured by Inoac Corporation is used to obtain Sheet-Shaped Foamed Elastic Member 5 having a thickness of 2.4 mm.

Fabrication of Foamed Elastic Member 6

A foamed urethane sheet (MF-20) manufactured by Inoac Corporation is used to obtain Sheet-Shaped Foamed Elastic Member 6 having a thickness of 2.4 mm.

Fabrication of Foamed Elastic Member 7

A foamed urethane sheet (MF-13) manufactured by Inoac Corporation is used to obtain Sheet-Shaped Foamed Elastic Member 7 having a thickness of 2.4 mm.

Fabrication of Foamed Elastic Member 8

A foamed urethane sheet (MF-8) manufactured by Inoac Corporation is used to obtain Sheet-Shaped Foamed Elastic Member 8 having a thickness of 2.4 mm.

Fabrication of Foamed Elastic Member 9

A foamed urethane sheet (MF-20) manufactured by Inoac Corporation is used to obtain Sheet-Shaped Foamed Elastic Member 9 having a thickness of 2.3 mm.

Fabrication of Cleaning Roller 1

Sheet-Shaped Foamed Elastic Members 2 and 6 are each cut into a strip having a width of 5 mm and a length of 360 mm.

Double-sided tapes having a thickness of 0.05 mm (No. 5605, manufactured by Nitto Denko Corporation) are attached to the entire surfaces, to be attached to a core, of the cut strips to obtain two strips with the double-sided tapes.

The two resulting strips with the double-sided tapes are placed on a horizontal stage such that the release paper attached to each double-sided tape faces downward. Both of the two strips are compressed from thereabove with stainless steel having its longitudinal end heated so that the thickness of a portion having a length of 1 mm from the longitudinal end of each strip in the longitudinal direction is 15% of the thickness of the remaining portion.

The two strips with the double-sided tapes are then placed on a horizontal stage at a distance of 0 mm (i.e., the two strips with the double-sided tapes are placed in contact with each other) such that the release paper attached to each double-sided tape faces upward. The two strips with the double-sided tapes are wound around a metal core (material: SUM24EZ, outer diameter: 5.0 mm, overall length: 338 mm) in a double-helical pattern at a helix angle θ of 25° while being tensioned so that the overall length of each strip increases by 0% to 5%.

By the foregoing process, Cleaning Roller 1 including two foamed elastic layers disposed around the outer peripheral surface of a core in a double-helical pattern is obtained.

The average skeleton sizes D1 and D2, the widths $W_C$ and $W_D$ of the foamed elastic layers, the helix angles $\theta_A$ and $\theta_B$, the separation distance d, and the thicknesses $T_A$ and $T_B$ of Cleaning Roller 1 thus obtained are summarized in Table 1 below.

Fabrication of Cleaning Rollers 2 to 10

Cleaning Rollers 2 to 10 including two foamed elastic layers disposed around the outer peripheral surface of a core in a double-helical pattern are obtained in the same manner as Cleaning Roller 1 except that Foamed Elastic Members 2 and 6 cut into strips are appropriately replaced with the foamed elastic members shown in Table 1 below.

The average skeleton sizes D1 and D2, the widths $W_C$ and $W_D$ of the foamed elastic layers, the helix angles $\theta_A$ and $\theta_B$, the separation distances d, and the thicknesses $T_A$ and $T_B$ of Cleaning Rollers 2 to 10 thus obtained are summarized in Table 1 below.

Fabrication of Cleaning Roller 11

Cleaning Roller 11 including two foamed elastic layers disposed around the outer peripheral surface of a core in a double-helical pattern is obtained in the same manner as Cleaning Roller 1 except that Foamed Elastic Members 2 and 6 cut into strips are replaced with Foamed Elastic Members 2 and 9.

The average skeleton sizes D1 and D2, the widths $W_C$ and $W_D$ of the foamed elastic layers, the helix angles $\theta_A$ and $\theta_B$, the separation distance d, and the thicknesses $T_A$ and $T_B$ of Cleaning Roller 11 thus obtained are summarized in Table 1 below.

Fabrication of Cleaning Roller 12

Sheet-Shaped Foamed Elastic Member 2 is cut into a strip having a width of 4 mm and a length of 360 mm. Sheet-Shaped Foamed Elastic Member 9 is also cut into a strip having a width of 4 mm and a length of 360 mm.

Cleaning Roller 12 including two foamed elastic layers disposed around the outer peripheral surface of a core in a double-helical pattern is obtained in the same manner as Cleaning Roller 1 except that these strips are used.

The average skeleton sizes D1 and D2, the widths $W_C$ and $W_D$ of the foamed elastic layers, the helix angles $\theta_A$ and $\theta_B$, the separation distance d, and the thicknesses $T_A$ and $T_B$ of Cleaning Roller 12 thus obtained are summarized in Table 1 below.

Fabrication of Cleaning Roller 13

Cleaning Roller 13 including two foamed elastic layers disposed around the outer peripheral surface of a core in a double-helical pattern is obtained in the same manner as Cleaning Roller 1 except that the two strips with the double-sided tapes are each wound around a core at a helix angle of 15°.

The average skeleton sizes D1 and D2, the widths $W_C$ and $W_D$ of the foamed elastic layers, the helix angles $\theta_A$ and $\theta_B$, the separation distance d, and the thicknesses $T_A$ and $T_B$ of Cleaning Roller 13 thus obtained are summarized in Table 1.

Fabrication of Cleaning Roller 14

A cleaning roller 14 including two foamed elastic layers disposed around the outer peripheral surface of a core in a double-helical pattern is obtained in the same manner as Cleaning Roller 1 except that the two strips with the double-sided tapes are placed at a distance of 2 mm when wound around a core.

The average skeleton sizes D1 and D2, the widths $W_C$ and $W_D$ of the foamed elastic layers, the helix angles $\theta_A$ and $\theta_B$, the separation distance d, and the thicknesses $T_A$ and $T_B$ of Cleaning Roller 14 thus obtained are summarized in Table 1.

TABLE 1

| | Foamed | Average skeleton size | | Width of foamed elastic layer | | Helix angle | | Separation | Thickness | |
|---|---|---|---|---|---|---|---|---|---|---|
| Cleaning Roller No. | Elastic Member No. | D1 (μm) | D2 (μm) | $W_C$ (mm) | $W_D$ (mm) | $\theta_A$ (°) | $\theta_B$ (°) | distance d (mm) | $T_A$ (mm) | $T_B$ (mm) |
| 1 | 2, 6 | 60 | 140 | 5 | 5 | 25 | 25 | 0 | 2.4 | 2.4 |
| 2 | 4, 8 | 100 | 270 | 5 | 5 | 25 | 25 | 0 | 2.4 | 2.4 |
| 3 | 1, 6 | 40 | 140 | 5 | 5 | 25 | 25 | 0 | 2.4 | 2.4 |
| 4 | 4, 6 | 100 | 140 | 5 | 5 | 25 | 25 | 0 | 2.4 | 2.4 |
| 5 | 4, 4 | 100 | 100 | 5 | 5 | 25 | 25 | 0 | 2.4 | 2.4 |
| 6 | 2, 8 | 60 | 270 | 5 | 5 | 25 | 25 | 0 | 2.4 | 2.4 |
| 7 | 3, 6 | 70 | 140 | 5 | 5 | 25 | 25 | 0 | 2.4 | 2.4 |
| 8 | 2, 5 | 60 | 120 | 5 | 5 | 25 | 25 | 0 | 2.4 | 2.4 |
| 9 | 6, 8 | 140 | 270 | 5 | 5 | 25 | 25 | 0 | 2.4 | 2.4 |
| 10 | 4, 7 | 100 | 240 | 5 | 5 | 25 | 25 | 0 | 2.4 | 2.4 |
| 11 | 2, 9 | 60 | 140 | 5 | 5 | 25 | 25 | 0 | 2.4 | 2.3 |
| 12 | 2, 6 | 60 | 140 | 4 | 4 | 25 | 25 | 0 | 2.4 | 2.4 |
| 13 | 2, 6 | 60 | 140 | 5 | 5 | 15 | 15 | 0 | 2.4 | 2.4 |
| 14 | 2, 6 | 60 | 140 | 5 | 5 | 25 | 25 | 2 | 2.4 | 2.4 |

Fabrication of Charging Roller 1

Formation of Elastic Layer

The following mixture for forming an elastic layer is kneaded in an open roll mill and is applied to the outer peripheral surface of a conductive core formed of SUS416 and having a diameter of 9 mm to form a cylindrical coating having a thickness of 1.5 mm. The coated core is placed in a cylindrical mold having an inner diameter of 12.0 mm, is vulcanized at 170° C. for 30 minutes, and is removed from the mold, following by polishing. In this way, a cylindrical conductive elastic layer is obtained.

Mixture for Forming Elastic Layer

Rubber material (epichlorohydrin-ethylene oxide-allyl glycidyl ether copolymer rubber, GECHRON 3106, manufactured by Zeon Corporation) 100 parts by weight Conductor (carbon black ASAHI THERMAL, manufactured by Asahi Carbon Co., Ltd.) 25 parts by weight Conductor (KETJEN BLACK EC, manufactured by Lion Corporation) 8 parts by weight Ionic conductor (lithium perchlorate) 1 part by weight Vulcanizing agent (sulfur, 200 mesh, manufactured by Tsurumi Chemical Industry Co., ltd.) 1 part by weight Vulcanization accelerator (NOCCELER DM, manufactured by Ouchi Shinko Chemical Industrial Co., Ltd.) 2.0 parts by weight Vulcanization accelerator (NOCCELER TT, manufactured by Ouchi Shinko Chemical Industrial Co., Ltd.) 0.5 parts by weight Formation of Surface Layer The following mixture for forming a surface layer is dispersed in a bead mill. The resulting dispersion is diluted with methanol, is applied to the surface (outer peripheral surface) of the conductive elastic layer by dip coating, and is dried by heating at 140° C. for 15 minutes. In this way, Charging Roller 1 including a surface layer having a thickness of 4 μm is obtained.

The average spacing Sm between irregularities in the surface of Charging Roller 1 thus obtained is 90 μm.

Mixture for Forming Surface Layer

Polymeric material (N-alkoxymethylated polyamide, "TORESIN", manufactured by Nagase ChemteX Corporation) 100 parts by weight Conductor (carbon black MONARCH 1000, manufactured by Cabot Corporation) 30 parts by weight Solvent (methanol) 500 parts by weight Solvent (butanol) 240 parts by weight Fabrication of Charging Roller 2

Charging Roller 2 is obtained in the same manner as Charging Roller 1 except that the mixture for forming a surface layer is replaced with the following mixture for forming a surface layer.

The average spacing Sm between irregularities in the surface of Charging Roller 2 thus obtained is 180 μm.

Mixture for Forming Surface Layer

Polymeric material (N-alkoxymethylated polyamide, FINE RESIN, manufactured Namariichi Co., Ltd.) 100 parts by weight Conductor (carbon black MONARCH 1000, manufactured by Cabot Corporation) 30 parts by weight Solvent (methanol) 500 parts by weight Solvent (butanol) 240 parts by weight

Examples 1 to 13 and Comparative Examples 1 to 3

Each combination of a cleaning roller and a charging roller shown in Table 2 is attached to a drum cartridge for a DocuCentre-V C7775 color multifunction machine (manufactured by Fuji Xerox Co., Ltd.) and is evaluated for cleaning performance.

The results are summarized in Table 2.

Cleaning Performance Evaluation

A strip-like image pattern with a length of 320 mm in the output direction and a width of 30 mm is printed on sheets of A3 recording paper at an image density of 100% in an environment at 22° C. and 55% RH. The charging roller is inspected for deposits at the image pattern printing position each time 10,000 sheets are printed.

Deposit inspection is performed by directly observing the surface of the charging roller under a confocal laser microscope (OLS1100, manufactured by Olympus Corporation), and the cleaning performance is evaluated.

Deposit inspection is performed at two points located 10 mm inward of both ends of the surface layer of the charging roller in the axial direction and at three points dividing the distance between these two points into four segments of equal length, and the number of rotations of the photoreceptor at which G3 on the following scale is reached is determined. Deposit inspection is also performed at the center of each of the above five points on the surface layer of the charging roller and at two points located ±1 mm from the center, i.e., at a total of three points for each of the above five points, and the number of rotations of the photoreceptor at which the maximum difference in deposit area between any three points reaches 40% or more is determined. The cleaning performance is evaluated based on the number of rotations of the photoreceptor at which any of these two measures is reached.

A larger number of rotations of the photoreceptor indicates a better cleaning performance.

Scale

G0: Deposits are found in 10% or less per $\mu m^2$ of the surface of the charging roller.

G0.5: Deposits are found in from more than 10% to 20% per $\mu m^2$ of the surface of the charging roller.

G1: Deposits are found in from more than 20% to 30% per $\mu m^2$ of the surface of the charging roller.

G2: Deposits are found in from more than 30% to 50% per $\mu m^2$ of the surface of the charging roller.

G3: Deposits are found in more than 50% per $\mu m^2$ of the surface of the charging roller.

TABLE 2

| | Charging | Cleaning | Relationship between Sm and average skeleton sizes D1 and D2 | | | Cleaning performance |
|---|---|---|---|---|---|---|
| | Roller No. | Roller No. | D1 (μm) | Sm (μm) | D2 (μm) | (×10,000 rotations) |
| Example 1 | 1 | 1 | 60 | 90 | 140 | 100 |
| Example 2 | 1 | 3 | 40 | 90 | 140 | 95 |
| Example 3 | 1 | 7 | 60 | 90 | 270 | 95 |
| Example 4 | 1 | 8 | 70 | 90 | 140 | 95 |
| Example 5 | 1 | 9 | 60 | 90 | 120 | 95 |
| Example 6 | 2 | 2 | 100 | 180 | 270 | 100 |
| Example 7 | 2 | 10 | 140 | 180 | 270 | 95 |
| Example 8 | 2 | 7 | 60 | 180 | 270 | 95 |
| Example 9 | 2 | 11 | 100 | 180 | 240 | 95 |
| Example 10 | 1 | 12 | 60 | 90 | 140 | 100 |
| Example 11 | 1 | 13 | 60 | 90 | 140 | 100 |
| Example 12 | 1 | 14 | 60 | 90 | 140 | 100 |
| Example 13 | 1 | 15 | 60 | 90 | 140 | 100 |
| Comparative Example 1 | 2 | 6 | 100 | 180 | 100 | 90 |
| Comparative Example 2 | 2 | 5 | 100 | 180 | 140 | 92 |
| Comparative Example 3 | 1 | 5 | 100 | 90 | 140 | 92 |

The above results demonstrate that the cleaning performance is maintained over a longer period of time in the Examples that in the Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device comprising:

a charging member that charges a member to be charged; and a cleaning member that is disposed in contact with a surface of the charging member and that cleans the surface of the charging member, wherein the cleaning member comprises a core and two foamed elastic layers disposed adjacent to each other in an axial direction around an outer peripheral surface of the core from one end to another end of the core in a substantially double-helical pattern, the two foamed elastic layers being a first foamed elastic layer having an average skeleton size D1 smaller than an average spacing Sm between irregularities in the surface of the charging member and a second foamed elastic layer having an average skeleton size D2 larger than or equal to the average spacing Sm between the irregularities in the surface of the charging member.

2. The charging device according to claim 1, wherein the average skeleton size D2 of the second foamed elastic layer is from about 1.2 times to about 3.2 times the average spacing Sm between the irregularities in the surface of the charging member.

3. The charging device according to claim 2, wherein the average skeleton size D2 of the second foamed elastic layer is from about 1.5 times to about 2 times the average spacing Sm between the irregularities in the surface of the charging member.

4. The charging device according to claim 1, wherein the average skeleton size D1 of the first foamed elastic layer is from about 0.3 times to about 0.8 times the average spacing Sm between the irregularities in the surface of the charging member.

5. The charging device according to claim 4, wherein the average skeleton size D1 of the first foamed elastic layer is from about 0.5 times to about 0.7 times the average spacing Sm between the irregularities in the surface of the charging member.

6. The charging device according to claim 1, wherein the average spacing Sm between the irregularities in the surface of the charging member is from about 50 μm to about 300 μm.

7. The charging device according to claim 6, wherein the average spacing Sm between the irregularities in the surface of the charging member is from about 70 μm to about 250 μm.

8. The charging device according to claim 1, wherein the first and second foamed elastic layers have different thicknesses.

9. The charging device according to claim 8, wherein the thickness of one of the first and second foamed elastic layers is from more than about 1 time to about 1.2 times the thickness of the other foamed elastic layer.

10. A process cartridge attachable to and detachable from an image-forming apparatus, the process cartridge comprising the charging device according to claim 1.

11. An image-forming apparatus comprising:

an electrophotographic photoreceptor;

the charging device according to claim 1, wherein the charging device charges a surface of the electrophotographic photoreceptor;

an electrostatic-latent-image forming device that forms an electrostatic latent image on the charged surface of the electrophotographic photoreceptor;

a developing device that develops the electrostatic latent image formed on the surface of the electrophotographic photoreceptor with a developer containing a toner to form a toner image; and a transfer device that transfers the toner image to a surface of a recording medium.

12. A unit for an image-forming apparatus, comprising:

a member to be cleaned; and a cleaning member that is disposed in contact with a surface of the member to be cleaned and that cleans the surface of the member to be cleaned, wherein the cleaning member comprises a core and two foamed elastic layers disposed adjacent to each other in an axial direction around an outer peripheral surface of the core from one end to another end of the core in a substantially double-helical pattern, the two foamed elastic layers being a first foamed elastic layer having an average skeleton size D1 smaller than an average spacing Sm between irregularities in the surface of the member to be cleaned and a second foamed elastic layer having an average skeleton size D2 larger than or equal to the average spacing Sm between the irregularities in the surface of the member to be cleaned.

13. A process cartridge attachable to and detachable from an image-forming apparatus, the process cartridge comprising at least the unit for an image-forming apparatus according to claim 12.

14. An image-forming apparatus comprising the unit for an image-forming apparatus according to claim 12.

* * * * *